US009850082B2

(12) United States Patent
Newhouse et al.

(10) Patent No.: US 9,850,082 B2
(45) Date of Patent: Dec. 26, 2017

(54) STORAGE CONTAINER

(71) Applicant: 3M INNOVATIVE PROPERTIES COMPANY, St. Paul, MN (US)

(72) Inventors: Kevin B. Newhouse, Houlton, WI (US); Bruce E. Tait, Woodbury, MN (US); Schoen A. Schuknecht, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 223 days.

(21) Appl. No.: 14/240,114

(22) PCT Filed: Dec. 17, 2012

(86) PCT No.: PCT/US2012/069987

§ 371 (c)(1),
(2) Date: Feb. 21, 2014

(87) PCT Pub. No.: WO2013/096147

PCT Pub. Date: Jun. 27, 2013

(65) Prior Publication Data

US 2014/0367395 A1 Dec. 18, 2014

Related U.S. Application Data

(60) Provisional application No. 61/579,734, filed on Dec. 23, 2011.

(51) Int. Cl.

| | |
|---|---|
| ***B65H 1/02*** | (2006.01) |
| ***B65H 31/34*** | (2006.01) |
| ***B65H 31/02*** | (2006.01) |

(52) U.S. Cl.

CPC ..... *B65H 1/02* (2013.01); *B65H 1/027* (2013.01); *B65H 31/02* (2013.01); *B65H 31/34* (2013.01);

(Continued)

(58) Field of Classification Search

CPC ..... B65H 1/02; B65H 31/34; B65D 81/02

(Continued)

(56) References Cited

U.S. PATENT DOCUMENTS 1,863,465 A * 6/1932 Borrowdale ..... B65H 31/18 271/213
4,478,663 A * 10/1984 O'Sullivan ..... B29C 59/046 156/202

(Continued)

FOREIGN PATENT DOCUMENTS

| | | |
|---|---|---|
| DE | 806 262 | 6/1951 |
| WO | WO 2011-038279 | 3/2011 |
| WO | WO 2011-038284 | 3/2011 |

OTHER PUBLICATIONS

Tincer, "Melt blending of ultra high molecular weight and high density polyethylene: The effect of 15 mixing rate on thermal, mechanical and morphological properties," *Polymer Engineering and Science*, Oct. 1993, vol. 33, No. 19, 1243-1250.

(Continued)

*Primary Examiner* — Anthony Stashick
*Assistant Examiner* — Raven Collins
(74) *Attorney, Agent, or Firm* — Philip P. Soo

(57) ABSTRACT

The provided containers (100, 200) and methods provide for gravitational alignment of a plurality of stacked articles (120), in which at least two edges (140, 142) of each article align along inner walls (108, 114, 208, 214) of a respective container. The aligning walls of the container are provided with low-friction surfaces to facilitate sliding and alignment of the articles. By aligning the stack of articles along two edges, the articles can be registered relative to not only each other but the container itself, thereby facilitating loading, unloading, and conversion of articles in the stack. Optionally, a compressible layer (147) opposing one or both of the aligning walls conforms and distributes stress along the (Continued)

non-aligning edges, thereby preserving registration of the articles relative to each other when the container is transported.

16 Claims, 9 Drawing Sheets

(52) U.S. Cl.
CPC ..... *B65H 2301/321* (2013.01); *B65H 2301/4229* (2013.01); *B65H 2301/42254* (2013.01); *B65H 2301/5115* (2013.01); *B65H 2401/11* (2013.01); *B65H 2401/14* (2013.01); *B65H 2405/21* (2013.01); *B65H 2701/1752* (2013.01); *Y10T 83/0476* (2015.04)

(58) Field of Classification Search
USPC ..... 211/50; 83/29; 220/660
See application file for complete search history.

(56) References Cited

U.S. PATENT DOCUMENTS

| | | | | |
|---|---|---|---|---|
| 5,836,448 | A * | 11/1998 | Weder | B65D 25/10 206/423 |
| 5,884,768 | A * | 3/1999 | Fox | A45C 13/36 206/305 |
| 6,497,406 | B1 | 12/2002 | Moore | |
| 7,669,727 | B2 * | 3/2010 | Hubbard | B65D 61/00 206/522 |
| 8,784,940 | B2 * | 7/2014 | Newhouse | B65H 27/00 427/355 |
| 2011/0192854 | A1 * | 8/2011 | Chen | B65D 21/0202 220/660 |

OTHER PUBLICATIONS

International Search Report for PCT International Application No. PCT/US2012/069987 dated Nov. 7, 2013, 7 pages.

* cited by examiner

STORAGE CONTAINER

CROSS REFERENCE TO RELATED APPLICATIONS

This is a national stage filing under 35 U.S.C. 371 of PCT/US2012/069987, filed Dec. 17, 2012, which claims priority to U.S. Provisional Application No. 61/579,734, filed Dec. 23, 2011, the disclosure of which is incorporated by reference in their entirety herein.

FIELD OF THE INVENTION

Provided are containers and related methods for storing and dispensing a plurality of stacked articles. More particularly, containers and methods are provided for storing and dispensing a plurality of stacked planar articles as might be encountered, for example, in a film manufacturing or shipping operation.

BACKGROUND

Film manufacturing operations commonly use specialized containers for storing and transporting films and related intermediary components for a given end product. These containers are especially useful for protecting high-grade films from the outside environment during shipment or perhaps to assist in organizing and/or dispensing their contents. In the case of optical films, for example, product is generally manufactured using a continuous roll-by-roll process, cut into individual sheets, and then manually stacked into a tray. This tray could then be transported to another location in the manufacturing facility for transport, storage, and eventually conversion (e.g. further processing and/or assembly).

For certain applications, protection of these films is paramount. To avoid contamination and prevent adjacent films in the stack from sticking to one another, it is common to line both sides of each sheet with a "pre-mask" film. The pre-mask film protects the underlying optical film from being scuffed and scratched from the adjacent layers of film sliding against each other. Notably, this relative sliding motion can occur at any time, including while stacking, transporting, or even during storage of these films. At some point, the optical films are converted, at which time the films are individually removed from the stack, the pre-mask layers peeled off, and the pristine film manually placed into the next converting process. Therefore, the pre-mask film not only incurs materials costs, but also extra labor, lost time, and the nuisance of their disposal.

As manufacturing operations have become more automated, however, it has been possible to reduce human involvement. For example, robotics can be used to pick and place films from a container into a converting process. Another example is a laser conversion process in which a computer-controlled laser beam cuts one or more film samples into pre-defined shapes prior to assembly. Automation has the potential to significantly improve the precision and reliability of a process, while lowering overall costs.

SUMMARY

One difficulty encountered when handling thin, polymeric films derives from their tendency to adhere to each other. When the sheets of film are initially stacked on top of one another, a thin layer of air is trapped between neighboring sheets. This air layer is often beneficial, because it facilitates subsequent removal of sheets from the stack. When the sheets are stacked horizontally, however, the weight of the stack causes the air to be gradually pressed out over time, leading to undesirable adhesion between the sheets. This is especially common with soft pliable films, with each tending to conform closely to the surface beneath it. When this occurs, a human will typically intervene by locating the seam between the top sheet and the layers beneath and manually peeling it off the stack. Often this is a pain staking process that offsets the aforementioned benefits of automation.

A second difficulty relates to the registration of the sheets in an automated process. In a conventional stacked configuration, the location of the sheets relative to each other is uncontrolled. Even if the sheets are initially aligned, they can shift within a container during transport and storage. Without a convenient way to register the sheets to an automated process, human intervention may again be required. Once again, the imposition of this manual step frustrates efforts to automate the process of picking films from the container and placing them into a conversion process.

The provided containers and related methods overcome these technical challenges by enabling gravitational alignment of the stacked sheets where at least two edges of each sheet are precisely aligned with matching inner walls of the container. The aligning walls of the container are provided with a low-friction surface and the container optionally includes at least one wall opposing an aligning wall that has a substantially compressible layer. By enclosing the stack of sheets along two edges, the sheets can be registered relative not only to each other but also to the container itself, thereby facilitating fully automated removal of sheets from the stack. Additionally, the presence of a compressible layer opposing one or both of the aligning walls preserves the registration of the sheets relative to each other even when that stack experiences vibrations and jostling in the container during transport.

In one aspect, a container for a plurality of stacked articles having a certain Shore D hardness is provided. The container comprises: a base having a bottom surface; and a frame extending outwardly from the base, the frame comprising: a first wall oriented at an oblique angle relative to the bottom surface; a second wall joined with the first wall, at least a portion of each of the first and second walls having a coefficient of friction not exceeding 0.1; and a third wall joined with the first and second walls to define a corner at least partially bounded by the first, second, and third walls, wherein at least a portion of the third wall is generally perpendicular to each of the first and second walls and comprises a non-scratching material having a Shore D hardness not exceeding the certain Shore D hardness.

In another aspect, a container for a plurality of stacked articles having a certain Shore D hardness is provided, the container comprising: a base having a bottom surface; and a frame extending outwardly from the base, the frame comprising: a first wall oriented at an oblique angle relative to the bottom surface; a second wall joined with the first wall to define a corner at least partially bounded by the first and second walls, at least a portion of each of the first and second walls having a coefficient of friction not exceeding 0.1; and at least one opposing wall generally facing one or both of the first and second walls, wherein at least a portion of the one or more opposing walls comprises a compressible layer that can be compressed to 75% of its original relaxed volume.

In still another aspect, a container for a plurality of stacked articles having a certain Shore D hardness is provided, the container comprising: a base having a bottom surface; a frame extending outwardly from the base, the frame comprising: a first wall oriented at an oblique angle relative to the bottom surface; a second wall joined with the first wall; a third wall joined with the first and second walls to define a corner at least partially bounded by the first, second, and third walls, wherein at least a portion of the third wall is generally perpendicular to each of the first and second walls and comprises a non-scratching material having a Shore D hardness not exceeding the certain Shore D hardness; and at least one opposing wall generally facing one or both of the first and second walls, wherein at least a portion of the at least one opposing wall comprises a compressible layer that can be compressed to 75 percent of its original relaxed volume.

In yet another aspect, a container for a plurality of stacked articles is provided, comprising: a base having a bottom surface; and a frame extending outwardly from the base, the frame comprising: a first wall oriented at an oblique angle relative to the bottom surface; a second wall joined with the first wall, at least a portion of each of the first and second walls having a coefficient of friction not exceeding 0.1; and a third wall joined with the first and second walls to define a corner at least partially bounded by the first, second, and third walls, wherein at least a portion of the third wall is generally perpendicular to each of the first and second walls and comprises a looped pile layer.

In yet another aspect, a method of registering a plurality of stacked articles in a container having an enclosure at least partially defined by a first wall, a second wall adjoining the first wall, and at least one opposing wall generally facing one or both of the first and second walls is provided, the method comprising: providing a low-friction surface to facilitate sliding of the articles along at least a portion of each of the first and second walls; providing a compressible layer along at least a portion of the at least one opposing wall, the layer capable of being compressed to 75 percent of its original relaxed volume; cutting the plurality of articles along two adjoining edges to define a pair of reference edges; and placing the plurality of articles into the enclosure such that the reference edges align with the first and second walls while the at least one opposing wall conforms to one or more edges of the articles that are not reference edges to preserve the alignment of the articles relative to each other.

DEFINITIONS

"Oblique" means oriented neither perpendicular nor parallel relative to each other.

DETAILED DESCRIPTION

The following sections describe the provided containers and methods in greater detail by way of illustration and example. Notably, some of the angles and dimensions shown in the figures may be somewhat exaggerated to offer clarity to the viewer and therefore may not be drawn to scale. It is further understood that these containers may be provided with or without their respective contents, depending on the desired application.

Figure 1:
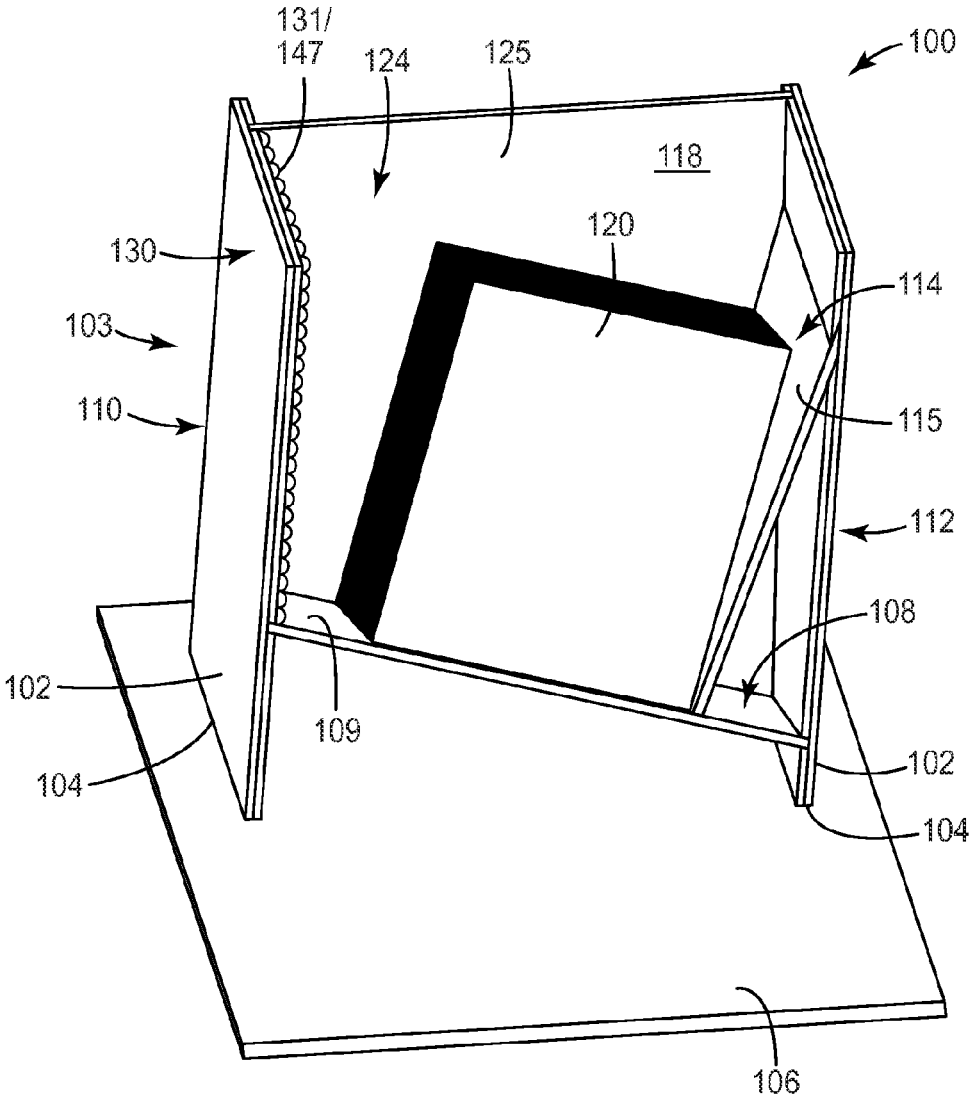
FIG. 1 is a front perspective view showing the front, left, and top sides of a container according to one exemplary embodiment.

A container according to one exemplary embodiment is illustrated in FIG. 1 and broadly designated by the numeral 100. The container 100 includes a left panel 110 and a right panel 112. As shown, the panels 110, 112 are planar and parallel. Optionally and as shown, the panels 110, 112 are rigid structures that have a fixed orientation relative to each other.

The panels 110, 112 collectively provide both a base 102 for the container 100 and sidewalls of a frame 103 that extend outwardly from the base 102. As shown in the embodiment of FIG. 1, the base 102 and frame 103 are integrally joined; in other words, the frame 103 is essentially an extension of the base 102, although this need not be the case. For example, the base 102 could be a discrete component joined to the bottom of the panels 110, 112.

The base 102 has a bottom surface 104 that rests flatly on a horizontal surface 106. The base 102 contacts the horizontal surface 106 along an elongated footprint that allows the container 100 to stand upright without wobbling. The bottom surface 104 and the horizontal surface 106 may extend along an entire length of one side of the container 100, as shown in FIG. 1, or only along a portion thereof. Alternatively, the base 102 could include three or more discrete legs (such as legs of a table) that independently contact the horizontal surface 106 along relatively smaller areas that are sufficiently spread apart to provide a stable foundation for the container 100.

Referring again to FIG. 1, the frame 103 provides an enclosure 118 for receiving a plurality of stacked sheets 120. In this figure, and subsequent figures, the plurality of sheets 120 are depicted as having the shape of a six-faced rectangular cuboid for the sake of simplicity. It is to be understood, however, that the sheets 120 are discrete, separable components and may be provided in non-rectangular shapes. For example, the sheets 120 could be polygonal in shape, have contiguous sides that are non-perpendicular, have one or more curved surfaces, and so forth. In an even broader sense, other stackable articles with any shape or size may be used in place of the sheets 120 depicted in the figure.

The enclosure 118 of the frame 103 is partially defined by a first wall 108, second wall 114, third wall 124, and an opposing wall 130 generally facing the second wall 114. Preferably, the enclosure 118 has dimensions that are static. In other words, it is preferred that the walls 108, 114, 124, 130 are fairly rigid and resist bending under usual operating conditions. Aspects of each wall, particularly aspects concerning their surface properties and orientation relative to each other, are described in the sections below.

The first wall 108 is planar and extends transversely across the space between the first and second panels 110, 112. The first wall 108 is also oriented at an oblique angle relative to the plane of the bottom surface 104. In the embodiment shown, the first wall 108 is directly attached to the panels 110, 112, thereby imparting additional structural strength to the container 100. The wall 108 could also be attached to the back wall 124, if so desired. FIG. 1, and the front view presented in FIG. 3, further show that the stacked sheets 120 are all aligned with a flat inner surface 109 of the first wall 108. In this preferred embodiment, the alignment between the inner surface 109 and the sheets 120 is achieved with the assistance of gravity, which tends to pull each sheet 120 downwards against the planar inner surface 109.

The inner surface 109 optionally includes a low-friction surface. The low-friction surface preferably extends along surface areas of the inner surface 109 that are in contact with the sheets 120. In some embodiments, the low-friction surface is a fluoroplastic surface. Fluoroplastics contemplated in the present description include partially fluorinated and perfluorinated fluoroplastics. Fluoroplastics include, for instance, those having interpolymerized units of one or more fluorinated or perfluorinated monomers such as tetrafluoroethylene (TFE), chlorotrifluoroethylene (CTFE), hexafluoropropylene (HFP), vinylidene fluoride (VDF), fluorovinyl ethers, perfluorovinyl ethers, as well as combinations of one or more of these. Fluoroplastics may further include copolymers comprising one or more of the fluorinated or perfluorinated monomers in combination with one or more non-fluorinated comonomer such as ethylene, propylene, and other lower olefins (e.g., C2-C9 containing alpha-olefins).

In other embodiments, the fluoroplastic includes polytetrafluoroethylene (PTFE). When PTFE is used, it may be used as a blend with another fluoropolymer and may also contain a fluoropolymer filler (in the blend or in the PTFE only).

More specifically, useful fluoroplastics also include those commercially available under the designations THV (described as a copolymer of tetrafluoroethylene, hexafluoropropylene, and vinylidene fluoride), FEP (a copolymer of tetrafluoroethylene and hexafluoropropylene), PFA (a copolymer of tetrafluoroethylene and perfluorovinyl ether), HTE (a copolymer of tetrafluoroethylene, hexafluoropropylene, and ethylene), ETFE (a copolymer of tetrafluoroethylene and ethylene), ECTFE (a copolymer of chlorotrifluoroethylene and ethylene), PVF (polyvinyl fluoride), PVDF (polyvinylidene fluoride), as well as combinations and blends of one or more of these fluoroplastics.

Any of the aforementioned fluoropolymers may further contain interpolymerized units of additional monomers, e.g., copolymers of TFE, HFP, VDF, ethylene, or a perfluorovinyl ether such as perfluoro(alkyl vinyl)ether (PAVE) and/or a perfluoro(alkoxy vinyl)ether (PAOVE). Combinations of two or more fluoroplastics may also be used. In some embodiments, fluoroplastics such as THV and/or ETFE and/or HTE are possible.

Non-fluorinated materials, such as ultra-high-molecular-weight polyethylene (UHMWPE), may alternatively be used to provide a low-friction surface. UHMWPE has comparable frictional characteristics to tetrafluoroethylene but has higher impact strength and better abrasion resistance. Particular properties of UHMWPE and blends thereof are described, for example, in Tincer, T and Coskun, M., "Melt blending of ultra high molecular weight and high density polyethylene: the effect of mixing rate on thermal, mechanical and morphological properties," Polymer Engineering and Science, 33 (19), 1243 (1993).

The low-friction surface preferably has a coefficient of friction that is sufficiently low to enable individual sheets 120 to slide along the inner surface 109 in response to light forces, such as gravitational forces. In some cases, a small degree of vibration may be used to induce proper alignment of the sheets 120 along the low-friction surface. For example, the container 100 could be manually or automatically shaken to facilitate the settling and alignment of the sheets 120 against the inner surface 109. In some embodiments, the low-friction surface has a coefficient of friction of at most 0.04, at most 0.05, at most 0.06, at most 0.07, at most 0.08, at most 0.09, or at most 0.1.

Figure 2:
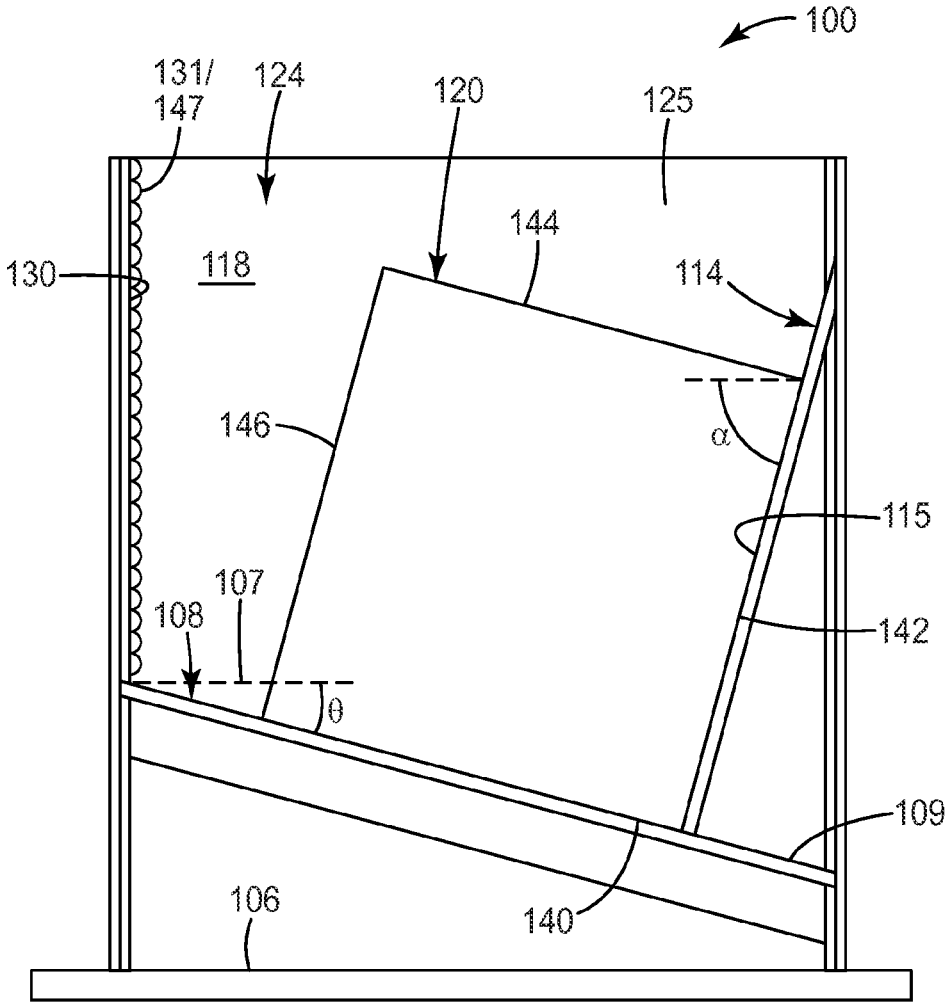
FIG. 2 is a front elevational view showing the front side of the container of FIG. 1.

FIG. 2 shows the container 100 as viewed from a direction perpendicular to the major surfaces of the stacked sheets 120. As shown in this figure, the first wall 108 (or its inner surface 109) is oriented at an oblique angle $\theta$ relative to a reference plane 107 parallel to the plane of the bottom surface 104. Preferably, the oblique angle $\theta$ is sufficient to allow gravitational forces to induce the plurality of sheets 120 to register along a first dimension (here, referred to as the "x"-dimension) perpendicular to the inner surface 109 of the first wall 108. Advantageously, this can allow the sheets 120 to be registered not only with respect to each other, but also with respect to the container 100. In some embodiments, the angle $\theta$ is at least 5 degrees, at least 10 degrees, at least 15 degrees, at least 20 degrees, or at least 25 degrees. In some embodiments, the angle $\theta$ is at most 25 degrees, at most 30 degrees, at most 35 degrees, at most 40 degrees, or at most 45 degrees.

Referring again to FIGS. 1 and 2, the registration of the sheets 120 occurs when a bottom edge 140 of each of the plurality of sheets 120 aligns with the inner surface 109 of the first wall 108. Preferably, the bottom edge 140 is a flat reference edge that matches a corresponding flat edge of the inner surface 109. It may be preferred that the first wall 108 is sufficiently rigid to allow the location and orientation of the reference edge to be precisely defined in a three dimensional coordinate space. Alternatively, the bottom edge 140 could also have an edge contour that is not flat. For example, the edge 140 could have a curved surface, irregular surface, or any other contoured surface that matches at least a portion of the inner surface 109.

The second wall 114 is contiguously joined to the first wall 108 with an orientation generally perpendicular to that of the first wall 108 thereby defining an edge at least partially bounded by the first and second walls 108, 114. In a preferred embodiment, the second wall 114 has an inner surface 115 that is also a low-friction surface. For example, the inner surface 115 could have properties similar or identical to those previously described with respect to the inner surface 109. As shown in FIGS. 1 and 2, the second wall 114 is oriented at an oblique angle $\alpha$ with respect to a reference plane parallel to the plane of the bottom surface 104. In some embodiments, the angle $\alpha$ is at least 5 degrees, at least 10 degrees, at least 15 degrees, at least 20 degrees, or at least 25 degrees. In some embodiments, the angle $\alpha$ is at most 25 degrees, at most 30 degrees, at most 35 degrees, at most 40 degrees, or at most 45 degrees. If the first and second walls 108, 114 are perpendicular, the sum of angles $\theta$ and $\sigma$ would equal 90 degrees.

As shown in FIG. 2, a side edge 142 shared by the plurality of sheets 120 flatly aligns with the complementally flat inner surface 115 of the second wall 114. As before, the force of gravity acts upon the sheets 120, urging the sheets 120 into respective positions that are registered along a second dimension (referred to as the "y"-dimension) perpendicular to the inner surface 115 of the second wall 114. The first wall 108 and second wall 114 thus provide adjoining sides of the enclosure 118 that collectively act to place the sheets 120 in a precise, registered position with respect to a reference plane parallel to each of the sheets 120. Once registered, the reference edges 140, 142 of each sheet 120 are aligned with corresponding inner surfaces 109, 115. Providing a low-friction surface along the inner surfaces 109, 115 is beneficial in lowering the resistance to sliding between the edges 140, 142 of the sheets 120 and the first and second walls 108, 114.

It is to be understood that the first and second walls 108, 114 need not be perpendicular to each other and, if so, the sheets 120 may adopt other shapes complemental to the walls 108, 114. For example, in an alternative embodiment, each stacked sheet could have the shape of an equilateral triangle, with each sheet partially enclosed by adjoining planar walls forming a 60 degree angle relative to each other. As a further observation, the orientations of the first and second walls 108, 114 can be varied independently of the orientations of the panels 110, 112. In FIGS. 1 and 2, for example, neither the first nor second wall 108,114 is directly defined by either of the panels 110, 112.

The third wall 124 is contiguously joined with the first and second walls 108, 114 as shown in FIGS. 1 and 2, thus providing an edge that is collectively bounded by the first, second, and third walls 108, 114, 124. The third wall 124 has a planar inner surface 125 that flatly engages the planar back surface of the stacked sheets 120. Consequently, the sheets 120 assume a uniform stack along a third and final dimension (referred to as the "z"-dimension) perpendicular to the inner surface 125 of the third wall 124. The first, second, and third walls 108, 114, 124 have a pre-defined configuration allowing an operator or manufacturing robot to determine, using the location and orientation of the base 104 as a reference point the location and orientation of the sheets 120 in x-y-z coordinate space. Depending on the dimensional tolerances of the container 100, this information can be provided with a high degree of precision. As illustrated in FIG. 2, the sheets 120 include edges 144, 146 that do not contact any of the first wall 108, second wall 114, third wall 124, or opposing wall 130. Depending on the application, the respective edges 144, 146 of individual sheets 120 in the stack may or may not be aligned with each other.

In a preferred embodiment, the third wall 124 has an inner surface 125 having a non-scratching surface provided by a material with a Shore D hardness not exceeding the Shore D hardness of the sheets 120. The non-scratching surface could take any of many different forms, including porous foams, fibrous layers, or thin films, some of which may not be subject to hardness measurements directly. Accordingly, "Shore D hardness," as used herein, refers to a Shore D hardness measurement performed on a solid slab of the material providing the non-scratching surface. To provide some examples, PTFE has a Shore D hardness of about 58, while PET has a Shore D hardness of about 87. In an exemplary embodiment, the non-scratching surface could have a Shore D hardness of at most 90, at most 80, at most 70, at most 60, or at most 50.

The non-scratching surface preferably extends over some or all of the inner surface 125 and preferably extends across any portions of the inner surface 125 necessary to prevent damage to exposed faces of the sheets 120 as they are placed into, or dispensed from, the container 100. The non-scratching surface could include, for example, a looped pile engagement surface made from poly(tetrafluoroethylene), aramid, polyester, polypropylene, nylon, and combinations thereof. These specialized surfaces can be used to avoid scuffing or abrading a polymeric film coming in contact therewith. Avoiding damage to the sheets 120 is especially important in applications involving fine or high grade films, such as optical films used in electronic devices. As a further advantage, a looped pile engagement surface could also serve a cleaning function by attracting and sequestering particulate debris present on the surfaces of the sheets 120. Further options and advantages of these surfaces are described in greater detail in PCT Publication Nos. WO 2011/038279 (Tait, et al.) and WO 2011/038284 (Newhouse, et al.).

Optionally, the inner surface 125 of the third wall 125 could also have the same low friction characteristics of the first or second walls 108, 114. Since the last (i.e. back-facing) member of the plurality of sheets 120 makes substantial contact with the third wall 125, use of a low friction surface significantly facilitates alignment of the edges 140, 142 of this last sheet along respective first and second walls 108, 114.

Figure 3:
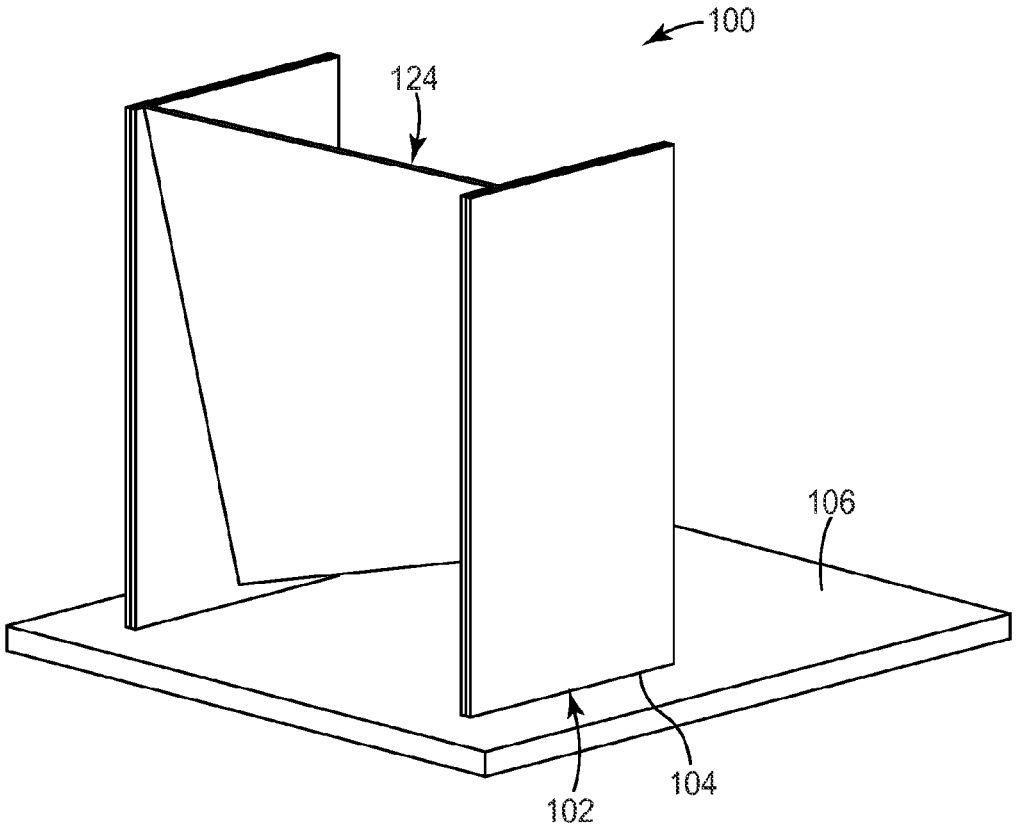
FIG. 3 is a rear perspective view showing the rear, left, and top sides of the container of FIGS. 1-2.

FIG. 3 shows a rear perspective view of the container 100, revealing that the third wall 124 is oriented at a certain tilt angle β relative to the plane of the bottom surface 104 of the base 102. Selection of a suitable tilt angle can help avoid many of the problems associated with conventional containers used in manufacturing operations. Conventional containers align the sheets horizontally, which causes tiny air pockets present between neighboring sheets to become gradually pressed out over time under the weight of the stack. It was discovered that these air pockets can be desirable because they provide a weak boundary layer that prevents sheets from sticking to one another. When the air is expelled from the interfacial surfaces separating the sheets, however, the sheets became difficult to dispense and can require an operator to manually locate a seam between the top layer and underlying layers to prevent multiple layers from inadvertently being dispensed at one time.

Proper choice of the tilt angle β associated with the third wall 124 can help alleviate this problem by orienting the sheets 120 to mitigate the adverse effect described above. Preferably, the tilt angle β of the third wall 124 relative to the bottom surface 104 is an acute angle approaching 90 degrees (i.e. a vertical orientation) to minimize compressive forces acting on the sheets 120 along a direction perpendicular to the third wall 124. At the same time, however, it is preferable that the tilt angle β is not too close to 90 degrees or else gravity could cause the sheets 120 to peel away, individually or collectively, from the third wall 124 and/or topple over while being stored in the container 100. In some embodiments, the tilt angle is at least 55 degrees, at least 60 degrees, at least 65 degrees, or at least 75 degrees. In some embodiments, the tilt angle is at most 87 degrees, at most 85 degrees, at most 83 degrees, or at most 80 degrees.

Figure 4:
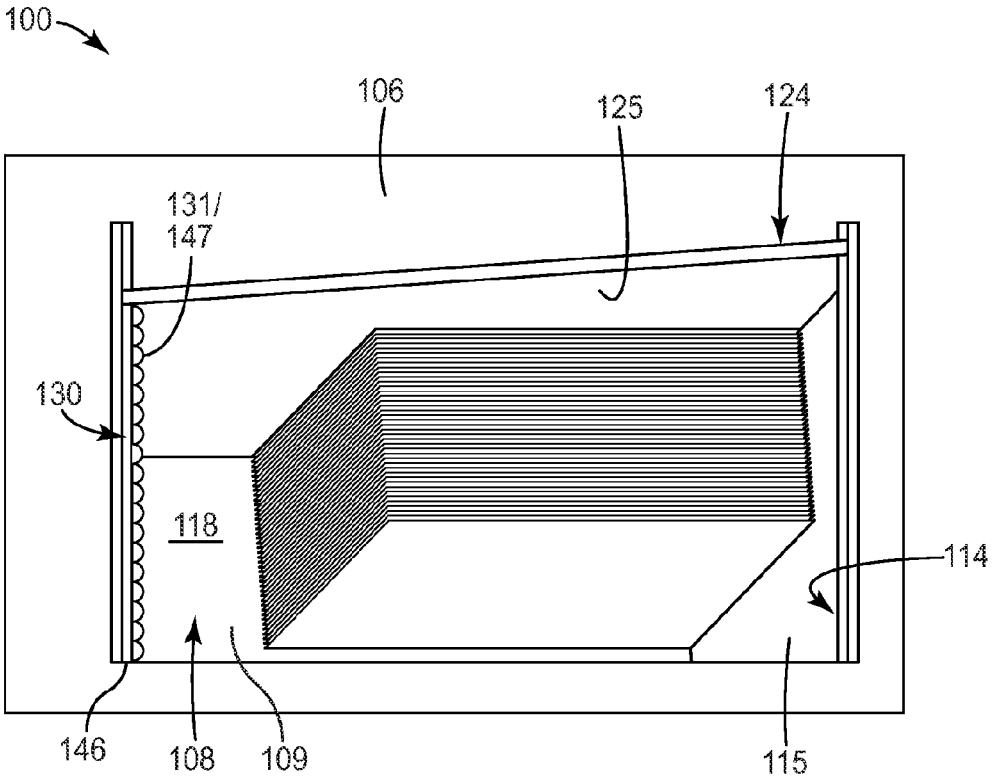
FIG. 4 is a top view showing the top side of the container of FIGS. 1-3.

FIG. 4 shows the container 100 as viewed from a direction perpendicular to the horizontal surface 106. This figure reveals that the sheets 120 are stacked flatly against each other in parallel relation, and collectively rest against the inner surface 125 of the third wall 124. Preferably, the rearmost sheet 120 has a major surface in uniform contact with the inner surface 125. Optionally and as shown, the third wall 124 need not be perpendicular to the panels 110, 112. As further shown in the figures, the opposing wall 130 has a respective inner surface 131 and faces the second wall 114, defining a fourth planar boundary of the enclosure 118. While the inner surfaces 115, 131 of the respective walls 114, 130 oppose one another, they need not be parallel.

In some embodiments, the opposing wall 130 includes a compliant, compressible layer 147. The compressible layer 147 can account for some or all of the inner surface 131 of the opposing wall 130. Preferably, the compressible layer 147 extends across areas of the opposing wall 130 facing the edges 146 of the sheets 120. In the configuration shown, the compressible layer 147 can advantageously serve a protective function after the sheets 120 have been registered against the first and second walls 108, 114. The compressible layer 147 can substantially conform to the edges of individual sheets 120 and distribute compressive forces uniformly along the edge 146. As a result, the layer 147 creates a "soft contact" between the opposing wall 130 and the sheets 120 and preserves the registration of the sheets 120 relative to each other even if they come into contact with the opposing wall 130 during handling or shipment of the container 100. This is especially advantageous when it is desirable to align the sheets 120 along the edges 140, 142 but not along the edges 144, 146.

As used herein, a "compressible material" is a material that is reduced in volume upon application of pressure. In some embodiments, the compressible layer includes an elastic compressible material. Elastic compressible materials include materials that substantially rebound (e.g., rebound to at least to 99% of the initial volume), preferably within 30 seconds at, for example, ambient temperatures, after release of the pressure used to compress the material.

The ratio of the compressed volume/initial volume (i.e., compressibility) can vary depending on the compressible material used. In some embodiments, the layer 147 is compressible to 75%, compressible to 65%, compressible to 55%, compressible to 45%, compressible to 35%, or compressible to 25% of its original relaxed volume. As used here, "compressibility" can describe materials that are not entirely solid—for example, a non-woven or foam material. In these cases, the initial volume can be defined with respect to an imaginary three-dimensional envelope required to contain the entire article, while the compressed volume can be defined with respect to another imaginary three-dimensional envelope that is only large enough to enclose the compressed article.

Examples of elastic compressible materials include, but are not limited to, polymeric foams, elastic scrims, elastic nonwovens, and combinations thereof. Particularly beneficial compressible materials include the looped pile engagement surfaces in PCT Publication Nos. WO 2011/038279 (Tait, et al.) and WO 2011/038284 (Newhouse, et al.). In some embodiments, the compressible material is a porous material. As used herein, a "porous material" is a material that includes pores (e.g., voids and/or vessels). In preferred embodiments, the pores are in communication with one another to facilitate compression of the porous material. Exemplary porous materials include foams (e.g., polymeric foams including, for example, cellulose foams), sponges, nonwoven fabrics, polymer fibers, cotton fibers, cellulose fibers, woven mats, nonwoven mats, scrims, and combinations thereof.

Figure 5:
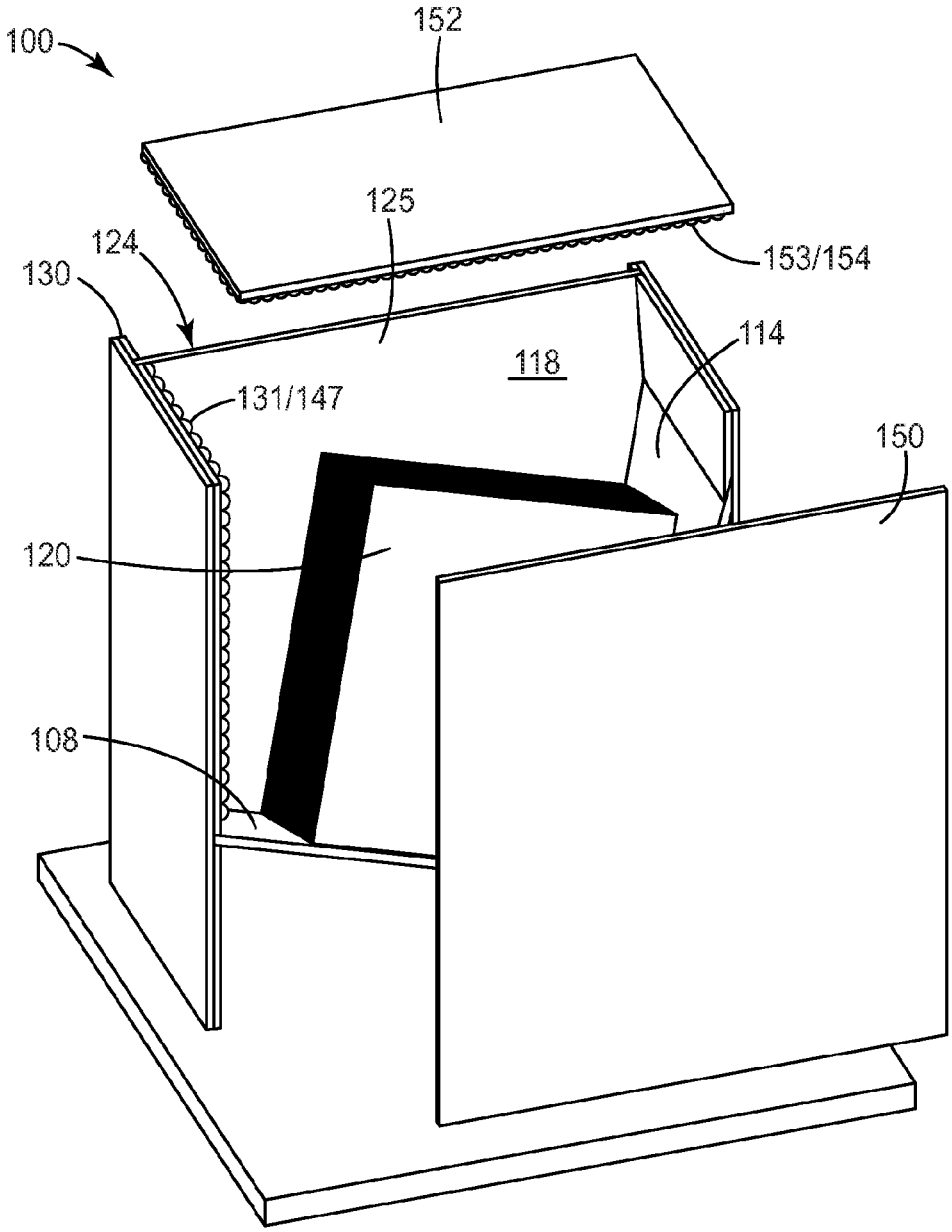
FIG. 5 is a perspective exploded view showing the front, left, and top sides of the container of FIGS. 1-4 along with optional ancillary components.
Figure 6:
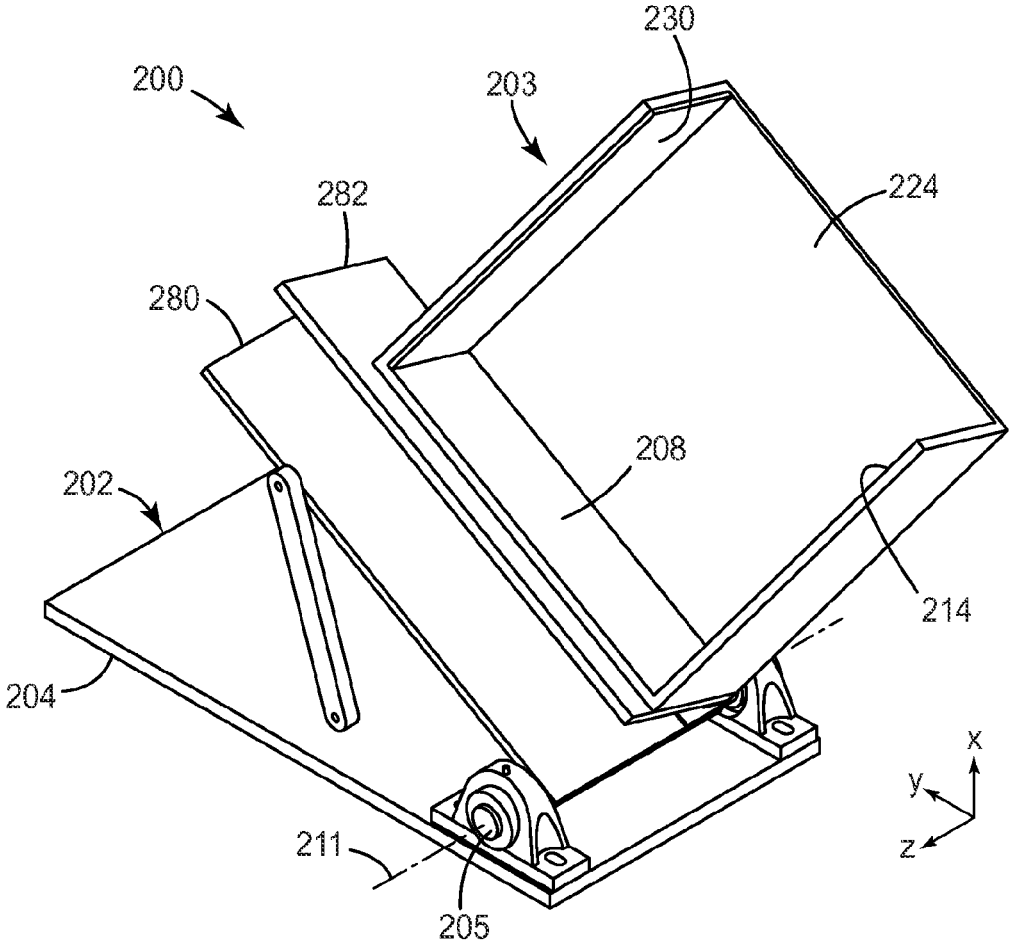
FIG. 6 is a perspective view showing the front, right, and top sides of a container according to another exemplary embodiment.

FIG. 5 shows the container 100 in exploded view with an additional front wall 150 and top wall 152, which oppose the third wall 124 and first wall 108, respectively. As shown, the first, second, third walls 108, 114, 124 act in combination with the opposing walls 130, 150, 152 to completely enclose the stacked sheets 120 within in the container 100. As an option, one or more of the opposing walls 130, 150, 152 may be partially or completely removable from the frame 103 to facilitate outside access to the sheets 120. For the convenience of an operator, one or more edges of one or both walls 150, 152 may be fastened to the frame 103 using a releasable latch. Alternatively, one or both walls 150, 152 could permit access to the enclosure 118 even while remaining attached to the frame 103. This could be accomplished by using, for example, a hinge between the wall 150, 152 and its adjoining wall, allowing the wall 150, 152 to swing open 270 degrees and lock against the outer surface of the frame 103.

Like the third wall 124, the wall 150 has an inner surface (not visible in FIG. 5) that faces the sheets 120 and includes a similar non-scratching surface (e.g. a looped pile layer) to avoid damage to the sheets 120 if contact between the sheets 120 and the inner surface of the wall 150 were to occur inadvertently during storage or transport of the container 100. As with first, second, and third walls 124, the inner surface of the wall 150 can advantageously be made from a low-friction surface, such as one having a coefficient of friction not exceeding 0.1.

Optionally and as shown, the wall 152, which opposes the first wall 108, has an inner surface 153 that includes a compressible layer 154. The compressible layer 154 can serve substantially the same purpose as previously described with respect to compressible layer 147 located on the wall 130. Accordingly, it preferred that the compressible layer 154 conforms to any uneven contours along the top edge 144 of the sheets 120 to avoid changing the registration of the sheets 120 within the stack relative to each other. Although not shown here, the sheets 120 could optionally be sized such that one or both of the compressible layers 147, 154 can apply gentle forces urging at least some of the sheets 120 toward the aligning edges 109, 115 of the container 100.

Figure 7:
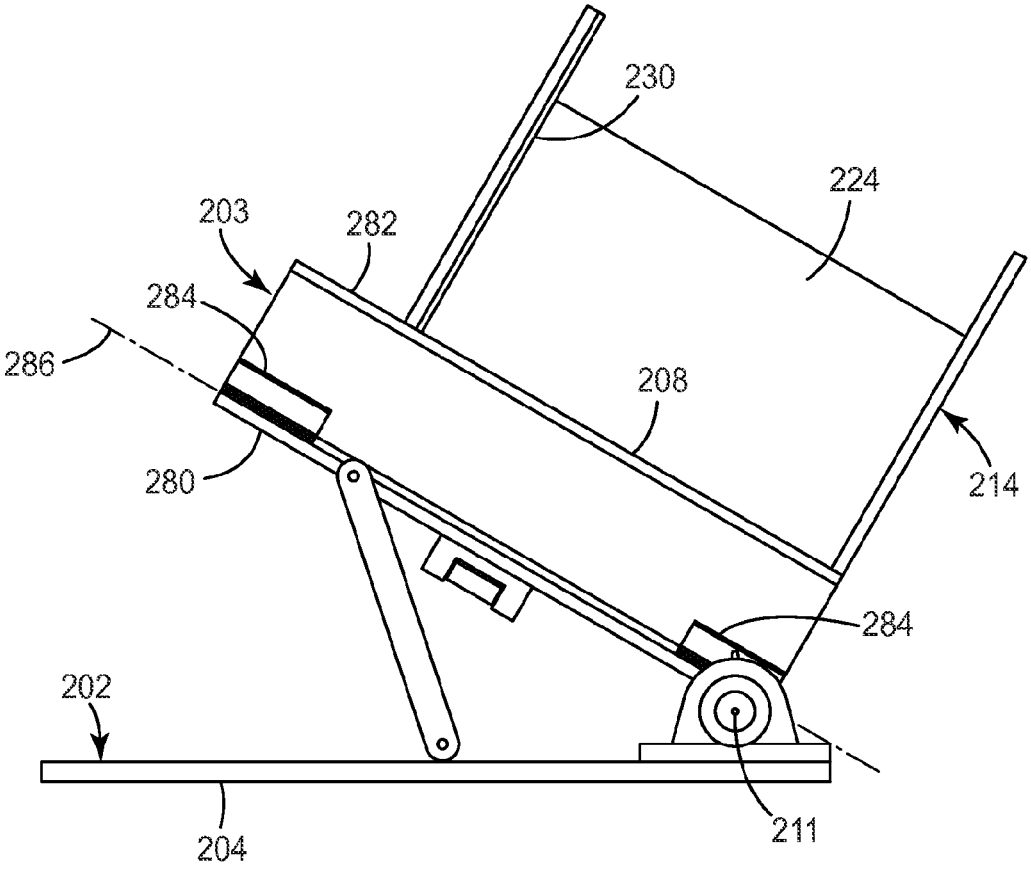
FIG. 7 is a front elevational view showing the front side of the container of FIG. 6.
Figure 8:
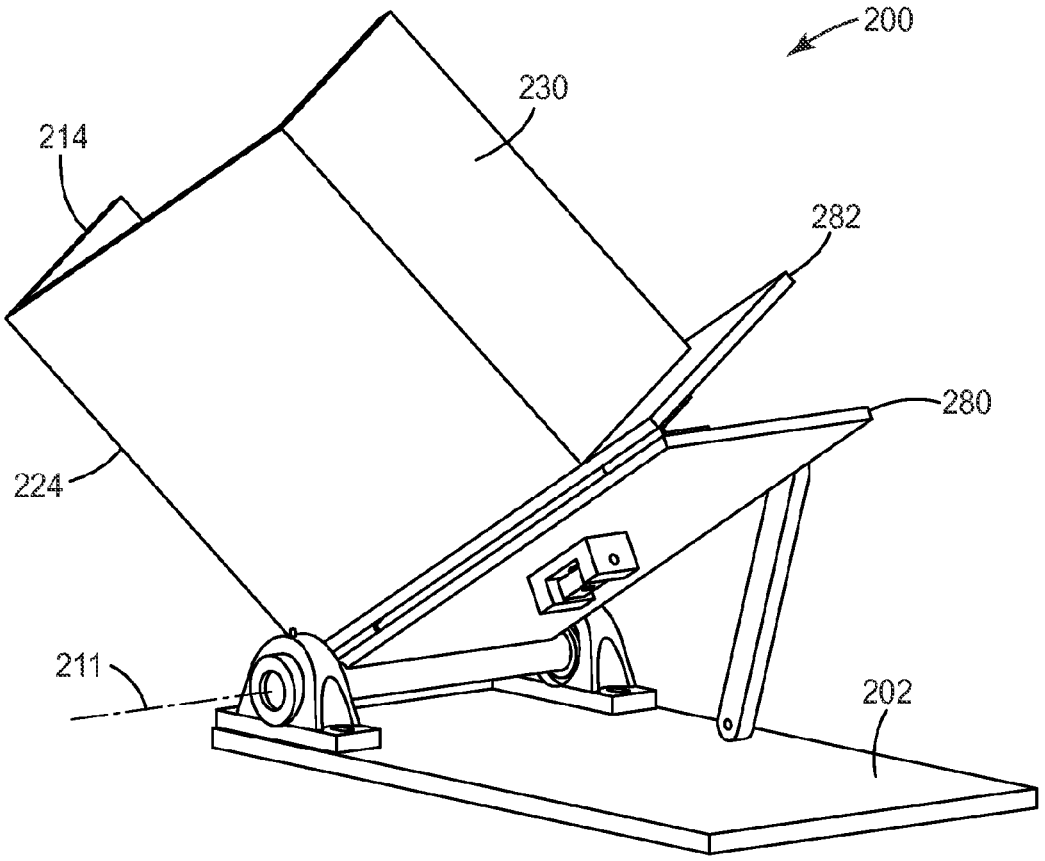
FIG. 8 is a perspective view showing the rear, left, and top sides of the container of FIG. 6-7.
Figure 9:
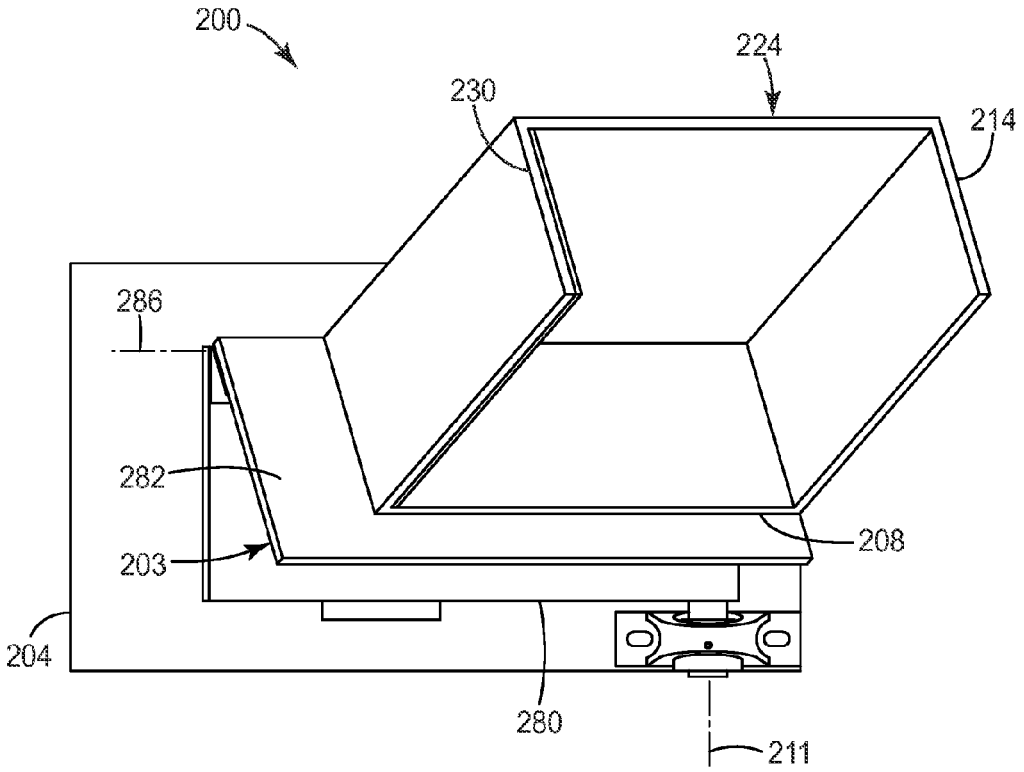
FIG. 9 is a top view showing the top, left, and front sides of the container of FIGS. 6-8.

Multiple views of a container assembly 200 according to another exemplary embodiment are provided by FIGS. 6-9. As shown, the assembly 200 has a discrete base 202 with a horizontal bottom surface 204. In this embodiment, the assembly 200 includes a first platform 280 and a second platform 282. The first platform 280 is connected to the base 202 by a pivot 205 allowing the first platform 280 to be rotated relative to the base 202 about a first rotation axis 211. The second platform 282, in turn, is joined to the first platform 280 along shared edges by a pair of hinges 284, as shown in FIG. 7. The hinges 284 allow the first and second platforms 280, 282 to rotate about a second rotation axis 286. In a preferred embodiment, these joints are mechanized to permit an operator to independently adjust two angles: (1) the angle between the bottom surface 204 and the first platform 280 about the axis 211, and (2) the angle between the first platform 280 and the second platform 282 about the axis 286.

Referring again to FIGS. 6-9, the second platform 282 is joined to a frame 203 that includes first, second, and third walls 208, 214, 224 and an opposing wall 230, which are fixed relative to each other. As previously described with respect to the container 100, additional walls opposing the first and third walls 208, 224 can be optionally included to complete the cuboid structure of the assembly 200, although these are not shown. Characteristics of the first, second, and third walls 208, 214, 224 and the opposing wall 230 are analogous to those of the walls 108, 114, 124, and 130 of the container 100 and will not be revisited here.

The ability to adjust the orientation of the frame 203 is convenient because the frame 203 can use conventional parallel and perpendicular walls while retaining many of the benefits of the container 100. Additionally, an operator has freedom to adjust the respective slopes of the walls 208, 214 to assist in gravitationally aligning sheets (or other articles) as previously described. The pivot 205 and hinges 284 further allow the location and orientation of the frame 203 to be precisely positioned for a manufacturing process, such as a pick and place operation. The assembly 200 also allows the frame 203 to be collapsed flush against the base 202 to conserve space during storage. If desired, the frame 203 could have a configuration allowing the frame 203 to be reversibly attached and detached from the second platform 282, allowing the more complex and expensive base 202 and platforms 280, 282 to be used interchangeably for multiple containers.

The container 100 and container assembly 200 may be advantageously used in any of a variety of known manufacturing or conversion processes. In an exemplary method, the container 100 or assembly 200 can be used to initially register the plurality of sheets 120 with respect to a manufacturing environment. The manufacturing environment may include, for example, robotics for transporting each of the sheets 120 to, or from, the container or assembly. Alternatively, the manufacturing environment could include a device used in processing or post-processing the sheets 120, such as laser or optical scanner.

In the examples above, the manufacturing environment can be registered to the frame 103, 203 of the respective container or assembly using one or more registration markers located on its base 102, 202. The registration markers could function mechanically, optically, or both. Registration between the manufacturing environment and the base 102, 202 could be accomplished, for example, by engaging the base 102, 202 to a horizontal surface in the manufacturing environment such that the registration markers are mechanically or visually aligned. In one embodiment, the manufacturing environment includes a pedestal having three or more physical features, such as protrusions or dimples, at known locations and having known geometries. These physical features are in registration with mating features located on the frame 103, 203 such that when the frame is properly positioned on the pedestal, the precise location and orientation of the frame 103, 203 can be automatically or semi-automatically determined from the known location and orientation of the pedestal.

Alternatively, in the above embodiment, the registration could be performed optically. For example, a plurality of optical indicia, such as dots, crosses, and the like, could be placed at known locations on the frame 103, 203. Once the frame 102, 203 has been placed in the manufacturing environment, an optical scanner located in the manufacturing environment, and controlled by a computer, could then scan the frame 103, 203 to identify the locations of the optical indicia. The computer, given the known geometry of the frame 103, 203, can use the scanned locations of the optical indicia to determine the location and orientation of the frame 103, 203 relative to the manufacturing environment.

With the manufacturing environment thus registered with the frame 103, 203, the manufacturing environment now has a reference point to control devices to place and register articles within the frame 103, 203 or act upon any articles already situated in the frame 103, 203.

In one exemplary method of registering a plurality of unregistered sheets 120 with the container 100, a stack of sheets 120 is first cut along two adjoining edges to create the reference edges 140, 142. Preferably, this operation is conducted using a laser cutting operation whereby the entire stack of sheets 120 is cut at one time to provide a matched geometry along each reference edge 140, 142. Once the reference edges 140, 142 have been created, the sheets can be placed into the enclosure 118. If needed, the enclosure 118 of the frame 103, 203 can then be oriented such that the junction between the first and second walls 108, 114 provides a lower corner datum facilitating spontaneous alignment of the reference edges 140, 142 with the respective first and second walls 108, 114 under the force of gravity.

In another exemplary method, the top and front sides of the container 100 or assembly 200 remain open while its enclosure is being filled. Once the loading of the container 100 or assembly 200 is complete, the top and front sides can be suitably covered by additional walls or panels (as previously described) and transported to the next value added process in the manufacturing environment.

All of the patents and patent applications mentioned above are hereby expressly incorporated into the present disclosure. The foregoing invention has been described in some detail by way of illustration and example for purposes of clarity and understanding. However, various alternatives, modifications, and equivalents may be used and the above description should not be taken as limiting in the scope of the invention which is defined by the following claims and their equivalents.

What is claimed is:

1. A container for a plurality of stacked articles, the container comprising:

a base having a bottom surface;

a frame extending outwardly from the base, the frame comprising:

a first wall oriented at an oblique angle relative to the bottom surface;

a second wall joined with the first wall, wherein the first and second walls are generally perpendicular to each other;

a third wall joined with the first and second walls to define a corner at least partially bounded by the first, second, and third walls, wherein at least a portion of the third wall is generally perpendicular to each of the first and second walls and at least a portion of the third wall comprises a fluoroplastic or ultra-high-molecular-weight polyethylene; and at least one opposing wall generally facing one or both of the first and second walls, wherein at least a portion of the at least one opposing wall comprises a compressible layer that can be compressed to 75 percent of its original relaxed volume.

2. The container of claim 1, wherein at least a portion of each of the first and second walls comprises a fluoroplastic or ultra-high-molecular-weight polyethylene.

3. The container of claim 1, further comprising a fourth wall and joined with the first wall, second wall, and at least one opposing wall, the fourth wall generally facing the third wall and comprising a non-scratching material having a Shore D hardness not exceeding 80.

4. The container of claim 1, wherein the first, second, and third walls are substantially planar.

5. The container of claim 1, wherein each of the first, second, and third walls faces away from the bottom surface.

6. The container of claim 1, wherein the first, second, and third walls collectively define an enclosure and further comprising the plurality of stacked articles received in the enclosure, the articles being registered with each other by virtue of having respective edges flatly aligned along each of the first and second walls.

7. The container of claim 1, further comprising a hinge located between the frame and the base, the hinge aligned along a reference axis perpendicular to the third wall and enabling the frame to tilt relative to the bottom surface about the reference axis.

8. The container of claim 7, wherein the hinge is a first hinge, the reference axis is a first reference axis, and further comprising a second hinge located between the frame and the base, the second hinge aligned along a second reference axis perpendicular to the second wall and enabling the frame to tilt relative to the bottom surface about the second reference axis.

9. The container of claim 1, wherein the compressible layer comprises a looped pile layer.

10. The container of claim 1, wherein the at least one opposing wall comprises a pair of opposing walls parallel to and facing the first and second walls, wherein each of the pair of opposing walls comprises a compressible layer that can be compressed to 75% of its original relaxed volume.

11. The container of claim 1, wherein the third wall is oriented at a tilt angle relative to the bottom surface, the tilt angle ranging from 55 to 87 degrees.

12. The container of claim 1, wherein the non-scratching material comprises a looped pile layer.

13. A method of registering a plurality of stacked articles in a container having an enclosure at least partially defined by a first wall, a second wall adjoining the first wall, and at least one opposing wall generally facing one or both of the first and second walls, the method comprising:

providing a low-friction surface to facilitate sliding of the articles along at least a portion of each of the first and second walls;

providing a compressible layer along at least a portion of the at least one opposing wall, the layer capable of being compressed to 75 percent of its original relaxed volume;

cutting the plurality of articles along two adjoining edges to define a pair of reference edges; and placing the plurality of articles into the enclosure such that the reference edges align with the first and second walls while the at least one opposing wall conforms to one or more edges of the articles that are not reference edges to preserve alignment of the articles relative to each other.

14. The method of claim 13, wherein the low-friction surface has a coefficient of friction of at most 0.1 with respect to the articles.

15. The method of claim 13, wherein the compressible layer has a coefficient of friction of at most 0.1 with respect to the articles.

16. The method of claim 13, further comprising orienting the enclosure such that the junction between the first and second walls provides a lower corner datum for the container to facilitate spontaneous alignment of the reference edges with the first and second walls under the force of gravity.

* * * * *